US008925982B2

(12) United States Patent
Bliding et al.

(10) Patent No.: US 8,925,982 B2
(45) **Date of Patent: *Jan. 6, 2015**

(54) LOCK DEVICE, A METHOD AND AN ARRANGEMENT FOR MOUNTING A LOCK DEVICE

(75) Inventors: Olle Bliding, Halmstad (SE); Johan Hörberg, Halmstad (SE); Lennart Sjöstedt, Åryd (SE); Jens Norshammar, Mellbystrand (SE); Thomas Persson, Munka Ljungby (SE)

(73) Assignee: Phoniro AB, Halmstad (SE)

( * ) Notice: Subject to any disclaimer, the term of this patent is extended or adjusted under 35 U.S.C. 154(b) by 1063 days.

This patent is subject to a terminal disclaimer.

(21) Appl. No.: 12/461,730

(22) Filed: Aug. 21, 2009

(65) Prior Publication Data

US 2010/0089109 A1 Apr. 15, 2010

Related U.S. Application Data

(63) Continuation-in-part of application No. PCT/EP2008/052010, filed on Feb. 19, 2008.

(30) Foreign Application Priority Data

Feb. 23, 2007 (SE) ..... 0700465
May 10, 2007 (SE) ..... 0701131

(51) Int. Cl.

| | |
|---|---|
| ***E05C 1/06*** | (2006.01) |
| ***G07C 9/00*** | (2006.01) |
| ***E05B 17/00*** | (2006.01) |
| *E05B 47/00* | (2006.01) |

(52) U.S. Cl.

CPC ..... *G07C 9/00944* (2013.01); *E05B 2047/0052* (2013.01); *E05B 2047/002* (2013.01); *E05B 17/0062* (2013.01); *E05B 47/0012* (2013.01)

USPC ..... 292/144; 292/142

(58) Field of Classification Search

CPC ..... E05B 65/006; E05B 65/1053; E05B 63/0056; E05B 47/0012; E05B 17/2084; E05B 17/04; E05B 9/084

USPC ..... 292/1, 92, 137, 163, 169, 138, 140, 292/142, 144, 317, DIG. 53, DIG. 63, 292/DIG. 64, 348, 349, 350, 354, 357, 279, 292/280, 355, 169.14, 169.17, 172, 292/DIG. 25, DIG. 26, DIG. 38, DIG. 54, 292/DIG. 60, DIG. 65, DIG. 57, 347; 70/277, 70/278.7, 279.1, 280, 282, 1.5, 422, 374, 70/451, 461

See application file for complete search history.

(56) References Cited

U.S. PATENT DOCUMENTS 3,287,044 A * 11/1966 Ahlgren ..... 292/17
3,899,907 A * 8/1975 Prahl ..... 70/370

(Continued)

FOREIGN PATENT DOCUMENTS

DE 296 17 063 4/1997
EP 1577587 9/2005

(Continued)

OTHER PUBLICATIONS

Extended search report for European patent application No. 12176024.3 dated Sep. 20, 2012.

(Continued)

*Primary Examiner* — Kristina Fulton
*Assistant Examiner* — Nathan Cumar
(74) *Attorney, Agent, or Firm* — Harness, Dickey & Pierce, P.L.C.

(57) ABSTRACT

In one embodiment of the present invention, a lock device is adapted to unlock a lock by transferring a lock catch from a locking position to a releasing position. The device includes an electric motor, which is mechanically connected to an axle via at least one transmission device, and rotation of the axle actuates the lock catch. In at least one embodiment, the transmission device includes a weakening structure adapted to break and disrupt the mechanical connection between the electric motor and the axle if a threshold force is exceeded.

24 Claims, 9 Drawing Sheets

(56) References Cited

U.S. PATENT DOCUMENTS

| | | | | |
|---|---|---|---|---|
| 4,024,739 | A * | 5/1977 | Kaufman | 70/97 |
| 4,271,691 | A * | 6/1981 | Logan | 70/422 |
| 4,305,611 | A * | 12/1981 | Robins | 292/238 |
| 4,395,063 | A * | 7/1983 | Bianco | 292/150 |
| 4,438,962 | A * | 3/1984 | Soloviff et al. | 292/144 |
| 4,708,007 | A | 11/1987 | Stoia | |
| 5,548,981 | A * | 8/1996 | Kirk | 70/58 |
| 5,632,120 | A * | 5/1997 | Shigematsu et al. | 49/449 |
| 5,857,365 | A * | 1/1999 | Armstrong | 70/279.1 |
| 5,961,162 | A * | 10/1999 | Glaser et al. | 292/198 |
| 6,012,310 | A * | 1/2000 | Hsiao | 70/278.2 |
| 6,062,612 | A * | 5/2000 | Lin | 292/144 |
| 6,296,286 | B2 * | 10/2001 | Glaser et al. | 292/198 |
| 6,406,072 | B1 * | 6/2002 | Chen | 292/144 |
| 6,739,164 | B2 * | 5/2004 | Warmack | 70/257 |
| 6,761,051 | B1 * | 7/2004 | Tsai | 70/38 B |
| 6,832,500 | B1 * | 12/2004 | Chen | 70/223 |
| 7,373,795 | B2 * | 5/2008 | Kilbourne | 70/278.1 |
| 7,516,633 | B1 * | 4/2009 | Chang | 70/472 |
| 7,845,201 | B2 * | 12/2010 | Meyerle et al. | 70/257 |
| 2001/0027669 | A1 | 10/2001 | Warmack | |
| 2003/0209043 | A1 * | 11/2003 | Yeh et al. | 70/280 |
| 2005/0050928 | A1 * | 3/2005 | Frolov et al. | 70/278.3 |
| 2006/0150694 | A1 * | 7/2006 | Frolov et al. | 70/277 |
| 2009/0173120 | A1 * | 7/2009 | Lin et al. | 70/279.1 |

FOREIGN PATENT DOCUMENTS

| | | |
|---|---|---|
| FR | 2595396 | 9/1987 |
| FR | 2806118 | 9/2001 |
| WO | WO 99/35356 | 7/1999 |
| WO | WO 2005/024160 | 3/2005 |
| WO | WO 2006/098690 | 9/2006 |

OTHER PUBLICATIONS

Communication for co-pending European patent application No. 08709103.9 dated Jan. 23, 2014.

* cited by examiner

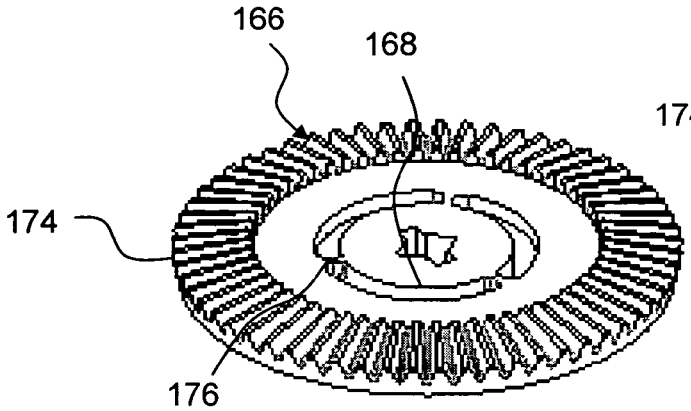
FIG 2a
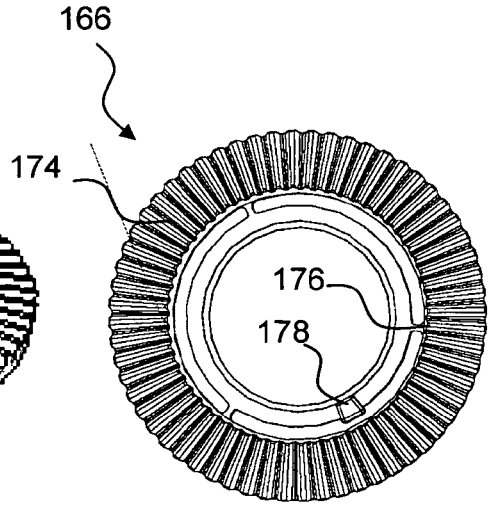
FIG 2b
FIG 3
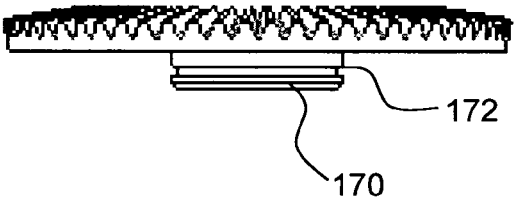
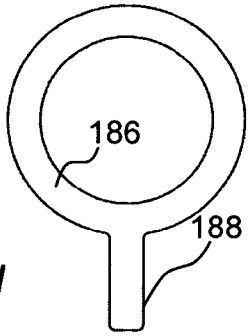
FIG 2d
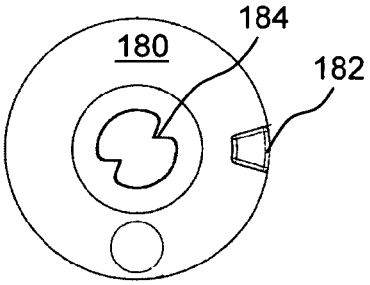
FIG 2c Current/mA
I
II
III
IV
V
Time/ms

LOCK DEVICE, A METHOD AND AN ARRANGEMENT FOR MOUNTING A LOCK DEVICE

PRIORITY STATEMENT

This application is a continuation-in-part of, and claims priority under 35 U.S.C. §120 and under 35 U.S.C. §371, PCT International Application Number PCT/EP2008/052010 which has an International filing date of Feb. 19, 2008, which designated the United States of America, and which claims priority on Swedish patent application number 0700465-8, filed Feb. 23, 2007 and Swedish patent application number 0701131-5, filed May 10, 2007, the entire contents of all of which are hereby incorporated herein by reference.

TECHNICAL FIELD

The present invention generally relates to access control, and more specifically to a device for unlocking a lock. The present invention also relates to an arrangement for mounting a lock device, and to a method therefore.

BACKGROUND OF THE INVENTION

The most common way to lock and unlock an access-controlling object such as a door is probably by using a mechanical key. This solution is cost efficient and easy to use, and a mechanical lock is hard to force. The drawbacks are, however, that the user always has to bring the key and that a user having a key always can obtain access, since the key itself does not incorporate any restrictions. These and other problems have been addressed by the present applicant in the previous application WO-2006/098690, which describes a device and method for unlocking a lock by a lock device enabled for short-range wireless data communication in compliance with a communication standard.

The device and method described in WO-2006/098690 presents a solution to the above problems. The present invention mainly relates to improvements in the lock device and its actuation, while the method related to communication between the lock device and external units may be similar to what has already been described in said previous application.

Desired features for the lock device is operational safety and low power consumption, and it is beneficial if this can be achieved with a device having a limited physical size. Though the device presented in the previous application was, and still is, advantageous there are improvements to be made within the above desired features.

SUMMARY OF THE INVENTION

The inventive device as disclosed in claim 1 alleviates several problems found in prior art as well as it presents further advantages as disclosed in the subclaims.

The inventive concept concerns a lock device adapted to unlock a lock by transferring a lock catch from a locking position to a releasing position. The device comprises an electric motor, which is mechanically connected to an axle by means of at least one transmission means, and rotation of said axle actuates said lock catch. The device is characterized in that the transmission means comprise a weakening structure adapted to break and disrupt the mechanical connection between the electric motor and the axle if a predetermined threshold force is exceeded.

In the event of the motor seizing there might occur a situation where the lock is impossible to unlock. Then the above solution makes it possible to dimension the weakening structure such that it can withstand the force needed to operate the lock, while it still is possible to apply a force large enough to break the weakening structure simply by using manual force, turning the knob or similar. The lock could seize in other ways and instead of breaking expensive and/or complex components in the lock the only thing that will break when the lock is forced opened is the weakening structure. This is a cost efficient solution and it also reduces the service costs.

The transmission means may comprise a gear wheel having a central region, a peripheral region, and an intermediate weakening region, wherein the weakening structure is arranged in the weakening region. The transmission means transfers the torque from the motor to the axle, and it is natural that it includes a gear wheel. The gear wheel is easily provided with a weakening region and it is generally a component which is inexpensive to keep in stock and simple to replace.

The weakening structure may comprise a structural weakening, such as apertures, recesses or cavities in the weakening region. This is an efficient way of obtaining a weakening region, e.g. by drilling or machining apertures leaving a well defined amount of material left.

The weakening structure may also/instead comprise an adhesive bond, releaseably bonding the central region to the peripheral region. Using an adhesive bond might offer a more cost efficient solution, since in case of the weakening structure braking, it might be sufficient to replace the adhesive bond instead of the entire gear wheel. The gear wheel may then be constructed from a more durable material.

The weakening structure may comprise at least one structure extending radially between the central region and the peripheral region. The use of a weakening structure wherein the gear wheel resembles a bike wheel with a variable number of spokes/radially extending structures, provides predictable characteristics and a distinguishable appearance.

According to one embodiment a method for mounting a lock device to a door leaf comprises the steps of: mounting a fastening plate to the door leaf; and mounting the lock device to the fastening plate. The use of a separate fastening plate enables a simple mounting, e.g., since the subsequent coupling between the fastening plate and the loch device may be independent from the fastening to the door blade. In one or more embodiments the design of the coupling enables positioning of the lock device at different angles relative to the fastening plate, which in turn makes it possible to position the lock device at different angles relative to the door plate. This enables full flexibility regarding the direction of the lock device (in the plane of the door blade).

In one or more embodiments the fastening plate may have a circular design, and the lock device may comprise a base plate configured to be attached to the fastening plate. The circular design of the fastening plate may enable for the base plate to be positioned at any angle relative to the base plate, resulting in the advantages already mentioned above.

In one or more embodiments the method may comprise the step of replacing a protective plate situated between the door leaf and a lock knob with the fastening plate, which results in additional advantages, in particular if the fastening screw openings used for the protective plate are utilized when fastening the fastening plate. Such protective plates are generally fastened by means of two or more fastening screws cooperating with fastening-screw openings in the door leaf or in an opposing fitting.

By using these openings no machining operations (such as drilling etc) have to be performed to the door blade or to the lock. This has the direct effect of facilitating the mounting of the lock device to the door, and also leaving the door unaffected such that e.g. certificates regarding fire classification, etc may remain.

In any embodiment of the method the lock knob may be temporarily removed from the lock during mounting.

An arrangement for performing a method according to one or more embodiments may comprise a fastening plate adapted for fastening to the door leaf and comprising means for fastening the lock device to the fastening plate. In one or more embodiments the fastening plate may comprise an annular projection with a circumferential groove for mating cooperation with fastening means of the lock device. The lock device may thus be arranged at defined or optional angles relative to the fastening plate.

The fastening plate may in one or more embodiments comprise projections extending towards the door leaf, in a mounted position, on the side facing the same. The projections will increase the friction between the fastening plate and the door leaf, which prevents the fastening plate from rotating during operation.

BRIEF DESCRIPTION OF THE DRAWINGS

The above, as well as additional objectives, features and advantages of the present invention, will be better understood through the following illustrative and non-limiting detailed description of preferred embodiments of the present invention, where the same reference numerals will be used for similar elements.

FIG. 2*a* is a detailed perspective view of a second gear wheel of the lock device.

FIG. 2*b* is a detailed plan view of an alternative design of the second gear wheel.

FIGS. 2*c* and 2*d* show additional components which can be used in connection with the second gear wheel of FIG. 2*b*

FIG. 3 is a side view of the gear wheel of FIG. 2*a*.

DETAILED DESCRIPTION OF PREFERRED EMBODIMENTS

Figure 1A:
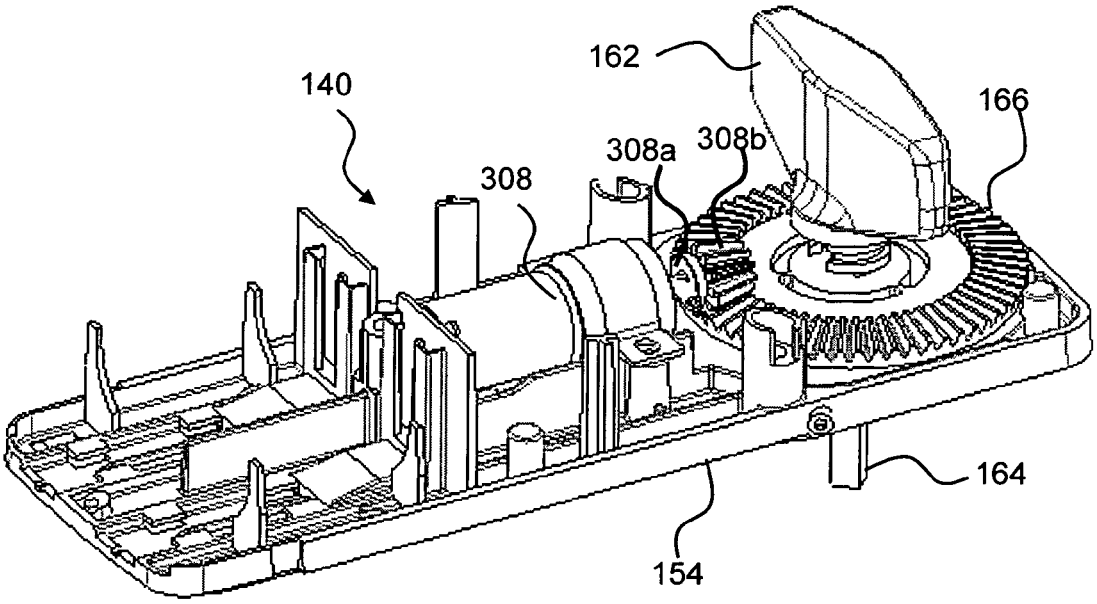
FIG. 1*a* is a perspective sectional view of a lock device using the inventive concept.

Referring now to FIGS. 1-4, a lock device 140 according to a first embodiment of the inventive concept will be described in more detail. In FIG. 1*b*, the door 150 is shown in more detail. In a well-known manner the door has a lock which includes an internal lock mechanism (not shown in FIG. 1*b*) as well as a door handle 161, a lock knob 162 and a lock catch 163. The lock knob 162 is mounted fixedly at one end of a rotatable axle 164 (FIG. 1*a*) in a known manner. The lock device 140 is mounted to a base plate 154 which is attached to the door leaf 152 next to the lock (not shown, situated in the lock case inside the door leaf in a known manner). A user may manually unlock the door lock, from the inside of the premises which are protected by the door 150, by turning the lock knob 162. This will cause rotation of the axle 164 and, ultimately, retraction of the lock catch 163 from its extended locking position in FIG. 1 to a retracted releasing position.

During mounting of the lock device the lock knob 162 is temporarily removed from the lock and the base plate 154 is mounted to the door leaf 152. The base plate 154 can obviously be mounted by using any suitable means, but generally it is mounted using pre-existing fastening screws which are used to fasten a protective plate that for most locks is situated between the lock knob and the door leaf. The idea is to cause no or minimal damage to the door blade 152. The reason for this is both related to improving the aesthetical appearance as well as not to compromise safety. With, e.g., metal doors the use of pre-existing fastening means, such as screws, also simplifies the actual mounting. In the illustrated embodiment the protective plate (not shown) has been replaced by a circular fastening plate (156, FIGS. 10-12) and the base plate 154 is subsequently fastened to the fastening plate 156. This arrangement simplifies the possibility of mounting the base plate 154 in different directions, since it can be arranged in any angle around the periphery of the fastening plate.

Figure 10:
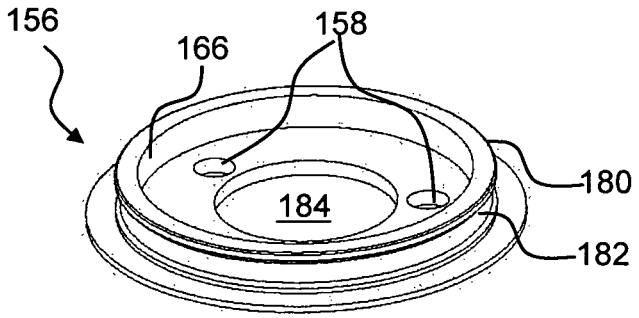
FIGS. 10-11 are schematic perspective views of a fastening plate.
Figure 11:
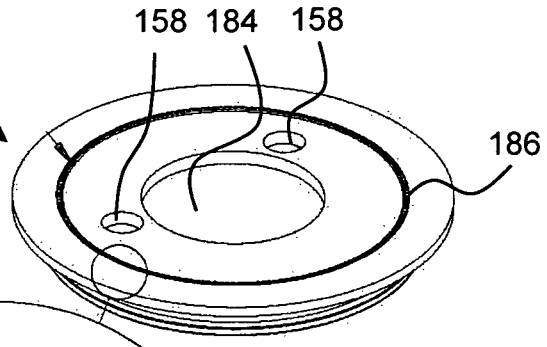
Figure 12:
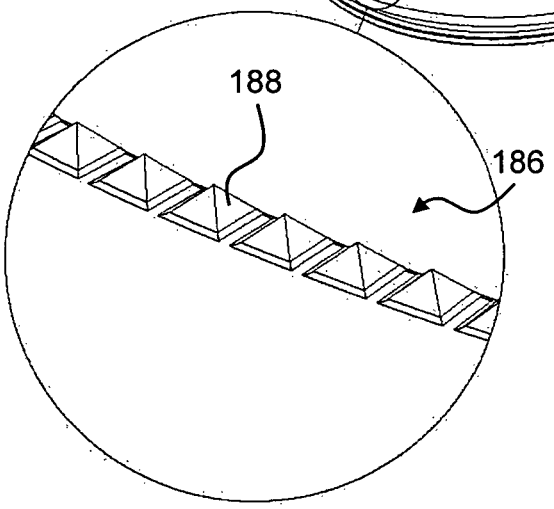
FIG. 12 is a detail view of a portion of the fastening plate of FIG. 11.

FIG. 10 is a perspective view of an upper side of the fastening plate 156, i.e. the side of the fastening plate 156 being directed away from the door leaf 152 when mounted. The fastening plate 156 is adapted for secure and easy mounting, and for that purpose it is provided with two holes 158 having dimensions and mutual distance corresponding to the dimensions and mutual distance of pre-existing fastening screws used for the protective plate which usually is present in relation to a lock arranged in a door leaf. In this context it should be emphasized that the hole pattern, number of holes, and various dimensions may differ for various lock standards, and that the illustrations of FIG. 10-12 are examples only. Nonetheless, the holes 158 enable simple mounting of the fastening plate by replacing the protective plate with said fastening plate 156. In this way the integrity of the door leaf 152 does not have to be tampered with, which otherwise could result in compromised safety, need for new certification (e.g. in regard of fire safety), etc.

The fastening plate 156 may further comprise an essentially annular projection 166 having a circumferential flange 180 on its free end. The annular projection 166 and the circumferential flange 180 define a circumferential groove 182, which may be used for mounting of the base plate 154 or other parts of a lock device. The lock device, or the base plate 154, may have a mating construction such that it may be inserted over the annular projection 166. After insertion, fastening means, such as screws, may be arranged to project into the groove 182 such as to secure the lock device to the fastening plate 156. The fastening plate 156 also has a central opening 184 to allow for a mechanical connection between the lock inside the door leaf and the lock device. The annular construction of the projection 166 makes it possible to arrange the lock device at various directions, basically in any angle around the projection 166. In many instances it suffices to have the lock device arranged in a vertical position or in a horizontal position, so other embodiments of the fastening plate may have a construction such that the lock device may be arranged in four directions only (left, right, up down). Further, there are other conceivable means for fastening the lock device to the fastening plate 156, instead of screws. Examples include spring biased balls, shrinkable fittings that may be inserted over the projection and then reduced in dimension. The projection may also be comprised of a number of segments divided by slits. In this way the segment may be resilient enough to flex and allow for a snap-fit with a mating construction of the lock device.

FIG. 11 is a perspective view of a lower side of the present embodiment of the fastening plate 156. Apart from what is already disclosed in FIG. 10 basically only one additional feature is visible, namely a knurled portion 186 of the lower side. This knurled portion, comprising a set of projections 188 (FIG. 12) extending along an annular path, will increase the friction between the door leaf and the fastening plate 156. It will also make the fastening plate act somewhat like a spring washer, which will prevent the pre-existing fastening screws from coming loose. A maximum radius of the knurled portion 186 should preferably be smaller than the minimum radius of the protective plate, so that any resulting marks on the door blade will not be visible if the lock device 140 is removed and the protective plate is put back into place.

Other components of the lock device 140 are mounted to the base plate 154. In the illustrated embodiment an iron less electric DC motor 308 is attached to the base plate 154. A transmission axle 308*a* of the motor 308 is provided with a first gear wheel 308*b* as transmission means. The gear wheel 308*b* has a frustoconical shape with axially extending teeth along its periphery and engages a second, larger gear wheel 166, the gear ratio being approximately 5:1. The gear ratio in the planetary gear (not shown) of the DC motor is approximately 24:1, resulting in an overall gear ratio of about 100:1. The larger gear wheel 166 is circular with a rotational axis coinciding with the rotatable axle 164 onto which the larger wheel 166 is mounted.

A motor controller 307 (FIG. 7) is coupled to the motor 308 and is adapted to provide a control signal 307*b* for engaging or disengaging the motor 308 and the carrier means. In turn, the motor controller 307 is controlled by a control signal 307*a* from a CPU 313 in the lock device 140.

Actuation of the motor 308, via the motor controller 307 thus rotates the transmission axle 308*a*, which in turn rotates the smaller gear wheel 308*b* causing it to rotate the larger gear wheel 166. Rotation of the larger gear wheel 166 cause rotation of the rotatable axle 164, which actuates the lock catch.

Figure 1B:
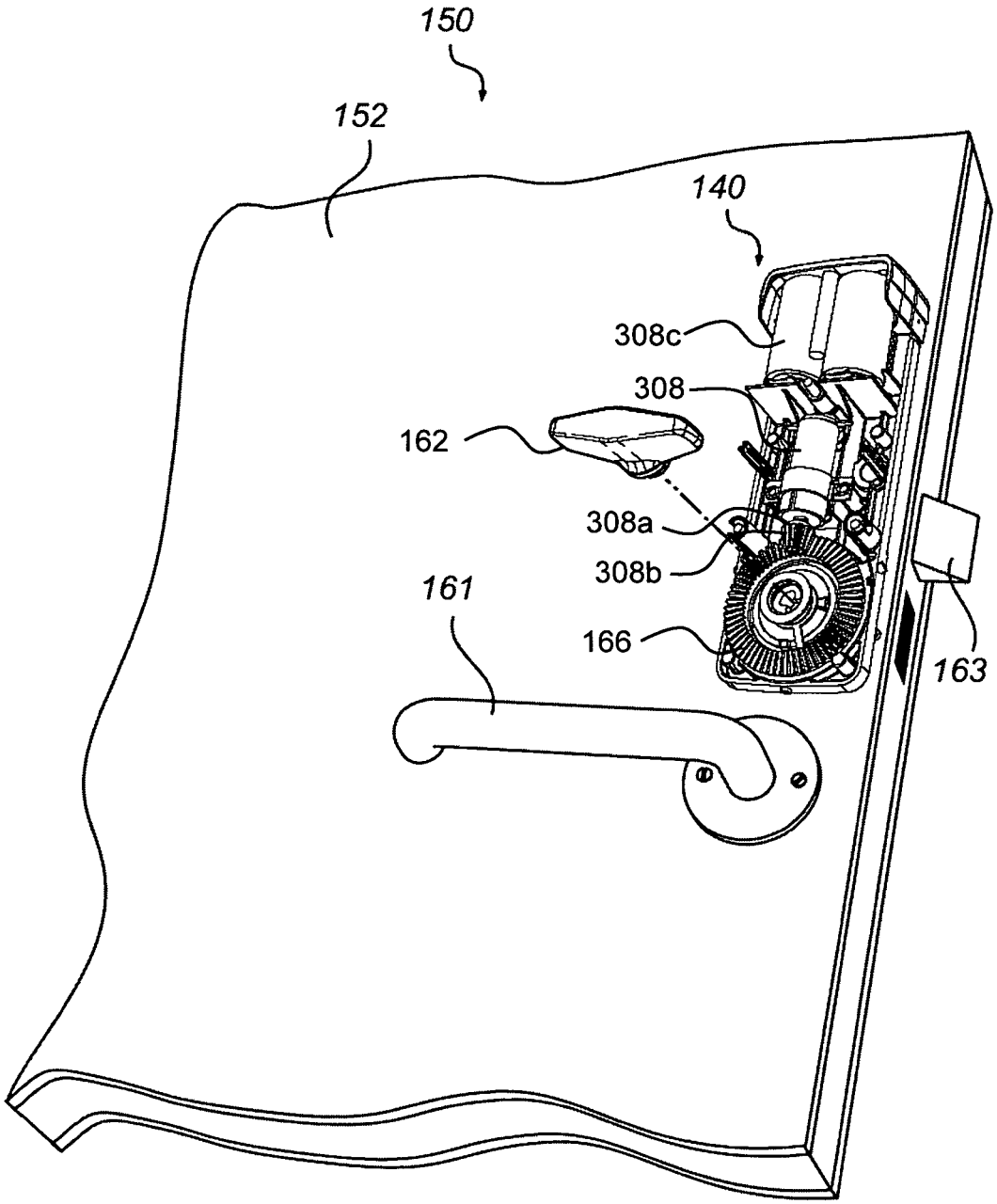
FIG. 1*b* is a another lock device using the inventive concept mounted to a door leaf.

For illustrative purposes the circuit board, comprising. e.g. a motor controller and communication means, is not shown in FIG. 1. A battery pack 308*c* (FIG. 1*b*) supplies the device with power.

The base plate also comprises attachment points for a protective cover (not shown). The lock knob 162 is arranged on the rotatable axle 164 after said protective cover has been mounted.

A user wanting to lock or unlock the door from the inside simply turns the knob 162 and thus actuates the lock catch and unlocks the door. This will also turn the larger gear wheel 166 and consequently rotate the transmission axle 308*a* of the DC motor 308. Since the described type of motor does not cause any significant mechanical resistance making the lock knob 162 difficult to turn, not even with the disclosed gear ratio, there is no need to include a disengagement system. Nevertheless a reason for adding a disengagement system could be to reduce the wear on components. Another reason could be that the mechanical friction in the lock, which is experienced when locking/unlocking manually using the knob 162, may remain unchanged, the lock will thus "feel" the same as before installation of the inventive system. The device of FIG. 1*b* actually includes a disengagement system which will be explained in more detail referring to FIGS. 2*b*, 2*c* and 2*d*.

The disengagement system basically operates as follows: A hub 180, having a lug 182 (see FIG. 2*c*) is concentrically arranged in engaging contact with the axle 164. When the axle 164 is turned, as a consequence of a user turning the knob 162, so is the hub 180. A ring 186 having an arm 188 (see FIG. 2*d*), is arranged coaxially with the hub 180 such that after the hub 180 has completed almost one revolution the lug 182 will engage the arm 188. The ring 186 will then rotate with the hub 180. After completion of a second revolution the arm 188 will engage a second lug 178 on the second gear wheel 166, and now at first the transmission will be engaged, via the second gear wheel 166. A user will consequently be able to turn the knob 162 almost two full revolutions before experiencing any additional resistance from the transmission means.

A user wanting to lock or unlock the door from the outside can either use a key or instruct the motor controller 307 to control the motor by any means described above or below.

FIG. 2*a, b* are detailed perspective views of a front side of a larger gear wheel 166 according to a second inventive concept, which may be used without the current-monitor function. The gear wheel is essentially circular and comprises three functional regions.

- A central region having, at its rotational centre, an axial through hole 168 having a shape that enables it to matingly cooperate with the rotatable axle 164. The central region comprises a circular projection 170, see FIG. 3, that fits in a hole in the base plate 154. Said circular projection 170 also comprises, around its outer periphery, a groove 172 in which it is possible to arrange a locking ring (not shown) once the projection 170 is inserted through the base plate 154.
- A peripheral region on which the gear teeth 174 of the second gear wheel 166 are arranged. The teeth 174 extends radially on the upper side of the gear wheel 162. The toothed portion is slanted outwardly in order to correspond to the frustoconical shape of the smaller gear wheel 308*b*.
- The central region and the peripheral region are coupled by a weakening region. The weakening region is essentially a small number (three in FIG. 2) of structures 176 extending radially between the central region and the peripheral region. The number and/or the dimensions, of the weakening structures 176 can and should be varied depending on the structural material as well as the predetermined force needed to break them. Generally the weakening structures 176 should withstand the forces expected during normal operation of the lock, i.e. the torque that can be delivered by the motor (with the gear ratio in mind). It should be noted that the weakening region also could be considered to be composed of the apertures/recesses/cavities being formed between the structures 176.

Note that the weakening structures described are examples only. Other examples include the use of glue, adhesive, etc between the central region and the peripheral region, or any other coupling having the desired properties.

Note that the position of the weakening region, between the central region and peripheral region, results in that it is not subjected to any significant force in a situation where the lock catch is actuated by means of the lock knob 162 from the inside or a physical key from the outside. The only force that they are subjected to in that situation is the force needed for rotation of the inactive DC motor.

The weakening region is useful if some part of the transmission, or even the DC motor, seize or get stuck in any other way. In such a situation it might be impossible to operate the lock device but with the lock knob, or with a key from the outside. Since the lock knob 162 is mechanically coupled to the motor, via the transmission means, the lock knob 162 too will be stuck. However, thanks to the weakening structures 176 of the weakening region it is still possible to turn the lock knob 162 and unlock the door. The weakening structures 176 will break when a predetermined threshold force is applied. The lower limit for this force was discussed above and the upper limit is that it should be easy to overcome manually by use of the lever action of the lock knob 162.

The broken larger gear wheel 166 is easily replaced at a low cost. In the illustrated embodiment the first gear wheel 308*b* is removed from the transmission axle 308*a*, and after the locking ring is removed from the groove 172 in the larger gear wheel 166 the latter can be removed and replaced. The fact that the weakening structures will break first reduces the risk of other components getting damaged during the forced opening of the lock.

Both the small and the large gear wheel can be made of polymer such as PTFE, polyamide, metal or any other suitable material.

A common feature for lock devices in prior art is that there is generally no simple way of determining the position of the lock catch. The angular position of a lock knob on the inside of the door is usually not reliable, since a lock catch also can be actuated by using a key from the outside. If the lock catch is locked/released with a key from the outside, this will generally not affect the angular position of the lock knob.

The solutions provided for in prior art for detecting the position of the lock catch in order to determine when the door is locked/unlocked, generally includes the provision of specific sensors in the actual lock mechanism which makes these alternatives more costly and complex, both in terms of components needed and in terms of installation efforts. They are also disadvantageous in terms of power consumption.

The device may comprise means for monitoring the current consumed by the DC motor over time. The sensor means include suitable components arranged on a circuit board. The current consumed by the motor is proportional to the torque its transmission axle 308*a* needs to overcome. Disregarding the frictional losses related to the gear wheels, this torque and thus the current, will be proportional to the force needed to move the lock catch.

In order to elucidate the function of the monitoring means, consider a case where initially the lock catch is in a locking position. From this position the DC motor can try to turn the rotatable axle 164 in a locking direction or an opening direction.

Figure 4:
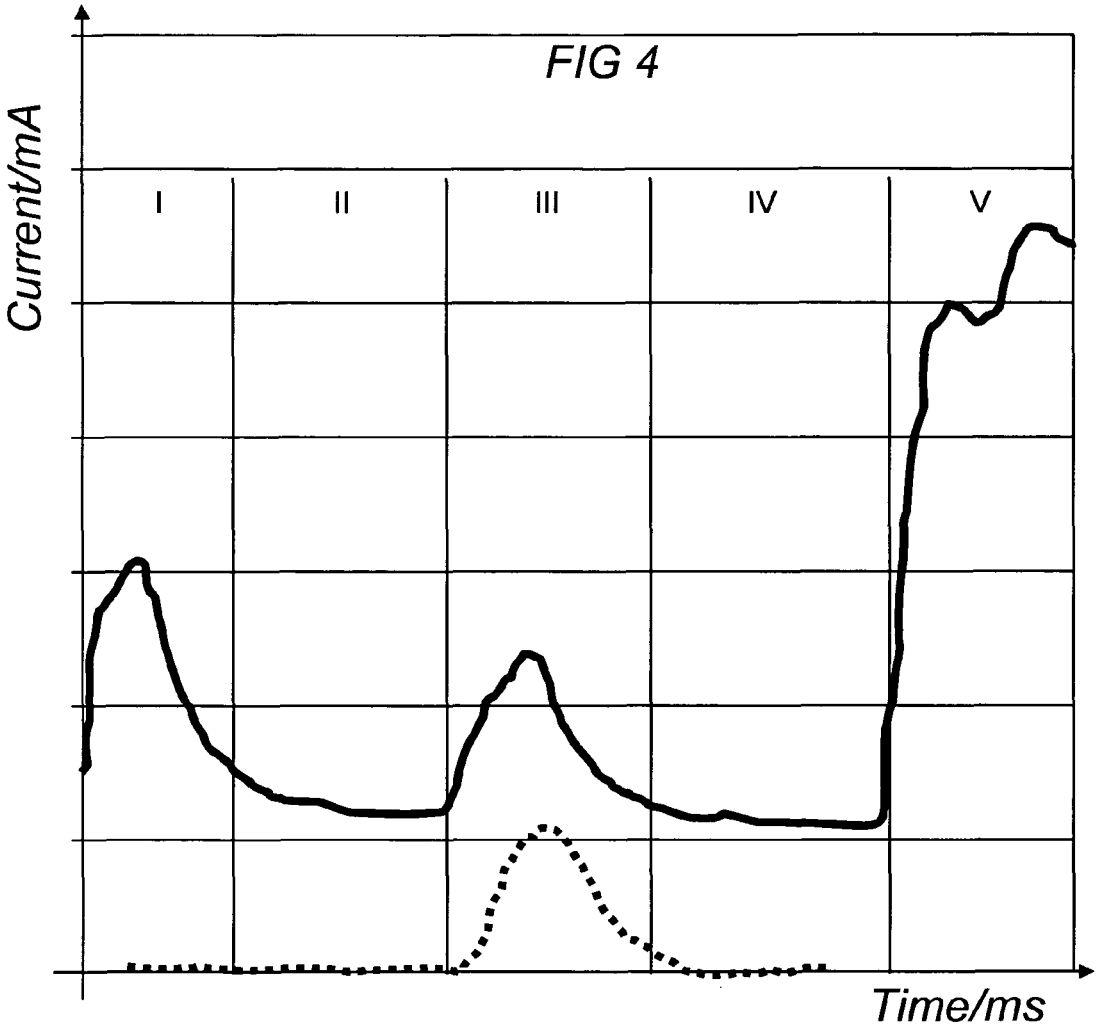
FIG. 4 is a diagram showing a current consumption as a function of time for a lock device according to one embodiment of the invention.

If the rotatable axle 164 is turned in a locking direction it will typically rotate with relative ease during a part of a revolution after which it reaches a permanent stop. In this case the monitor means will detect a low, essentially constant current consumption followed by a rapid increase in consumption, as shown in FIG. 4.

On the other hand, if the rotatable axle is turned in an opening direction it will typically rotate with relative ease until it starts engaging the lock catch. At that point there will be an increase in the force needed for rotation of the axle, and thus in the consumption of current. Once the lock catch reaches a releasing position the rotatable axle will again rotate with relative ease until it also in this case reaches a permanent stop. In this case the monitor means will detect a low, essentially constant current consumption followed by an increased, but still moderate temporary increase in consumption, followed by a low, essentially constant consumption followed by a rapid increase in consumption.

It should be understood that if the lock catch is in a releasing position the current consumption properties will be essentially reversed. In this context it should also be mentioned that there are lock mechanisms for which the lock catch is locked or released in two consecutive steps, which will have an obvious impact on the appearance of the current consumption curve.

In practise a reference current is recorded once the lock device is installed. As a first step in a referencing procedure the lock catch is first manually positioned in maximum locked position. The second step is to initiate the automatic part of the procedure. The motor is then instructed to rotate in one direction and when it has reached the end of that rotation it reverses and rotates in the other direction until it again reaches a permanent stop.

FIG. 4 shows an example of a recorded reference current as a function of time. The diagram showed in FIG. 4 illustrates a situation where the rotatable axle 166 has been turned in an opening direction. It is evident from the curve (full line) that there is a start current followed by the above mentioned low, essentially constant current consumption. Thereafter the lock catch is operated, indicated by the well defined increase and decrease in current consumption, again followed by a constant region. At the end the lock catch reaches its permanent stop position, which results in a rapid increase in current consumption. After current components like start current and such have been removed, a corrected current curve can be obtained, the dotted line of FIG. 4.

The inventive use of the monitoring of the current opens up for several evaluation parameters. First, after the referencing procedure is finalized the lock device has recorded the reference current and deduced the answer to a number of questions from this, e.g.:

i) Which one is the closing direction? This makes it possible to install the lock device to any type of door (opening left or right) without tailor-made configurations.

ii) What are the characteristics when the lock device reaches a permanent stop?

iii) What are the characteristics when the lock catch is actuated?

iv) What are the characteristic time periods between events, e.g., from lock actuation to permanent stop?

The answers to the above questions provide detailed information which may be used during actual locking and unlocking of the lock using the lock device. Further evaluation parameters include:

v) Estimation of power consumption, estimation of life time

For the type of lock device described the power consumption is a feature which is particularly interesting to monitor. For the device, small batteries providing large currents, such as lithium-thionyl chloride batteries, are preferably used. The characteristics of this type of battery is not unambiguously connected to the power left in the battery. Therefore it is advantageous to measure and store the power consumption and from that estimate the remaining life time of the battery, since the internal resistance is increased and therefore the maximum output current is lower when little capacity is left in the battery.

vi) Measurement of peak current, compare later during operation or additional referencing procedure, The peak current may then be compared with the peak current during a later referencing procedure, or during the actual use of the lock device. This measurement too can be used for estimation of the power left in the battery.

Generally, measured changes in the evaluation parameters can be attributed to changes in the components of the device. This includes properties of the battery as discussed above, but also the status for the mechanical components. As the mechanical components of the lock device or the lock get worn, this will affect the internal friction and thus the appearance of the monitored current. The evaluation parameters can thus be used to trigger an overhaul of the lock device, in which gear wheels and/or other components are exchanged.

In a simple embodiment only the characteristics concerning the permanent stops are used. It is evident from the diagram of FIG. 4 that a threshold value can be set for this purpose. Once the threshold value has been reached it can be determined that an end position has been reached, and the motor can be stopped in order to save power.

If a person activates the lock device from the outside, e.g., by knocking on the door, the lock device will first confirm that the individual knocking on the door is permitted to enter. Then the motor will rotate in an opening direction, and stop rotating once the threshold value is reached, irrespective of if the lock catch was locked or released to begin with. The individual can then enter.

If a person activates the lock device from inside, e.g., by pressing a button initiating a locking procedure, the lock device will first confirm that there are means, such as a portable phone with access rights, in the vicinity (to prevent the individual from locking him- or herself out), after which it will rotate the motor in a closing direction until the current consumption reaches the threshold value.

If desired it is always possible to use the lock knob to lock/unlock the door from the inside as well as a key to lock/unlock the door from the outside.

In more elaborate embodiments the summation current consumed during the actuation of the lock catch can be used. In other embodiments the inclination of the curve can be used instead of the threshold value. Both these actions make it possible to stop the motor even earlier and thus reduce the power consumption further. The power consumption is an issue since the lock device preferably is battery operated in order to simplify the installation procedure. Mechanical wear caused by strain of the components is also an issue, and this is also reduced by using the above method. The present lock device can be installed on any existing lock having rotatable lock actuating means on the inside, and can with ease be installed on most commercial locks using a lock knob, yet the inventive concept can also be used when constructing a lock in which the components of the described lock device are arranged in a lock case.

The present invention may advantageously be used in connection with the method and device disclosed in the above-mentioned WO 2006/098690. This document describes a communication function that may preferably be realized in a method for unlocking a lock by a lock device enabled for short-range wireless data communication in compliance with a communication standard, the method comprising the steps of:

a) detecting a key device within operative range of the lock device;

b) determining a wireless communication address of the key device;

c) evaluating the determined key device address by reference to a data storage with a number of wireless communication addresses stored therein;

d) generating an evaluation result from said evaluating step c), wherein a match between the determined key device address and any of the wireless communication addresses stored in the data storage is a requisite for a positive evaluation result; and e) unlocking said lock if a positive evaluation result is generated in step d).

Steps a) and b) of detecting and determining are performed without establishment of any two-way communication link between lock device and key device pursuant to said communication standard, and therefore the unlocking method according to a first aspect is much faster than the unlocking method previously known. Moreover, it will allow also less advanced wireless communication devices to act as key devices.

The communication standard is preferably BlueTooth™, and steps a) and b) may thus involve:

paging for BlueTooth™ enabled devices within operative range by sending inquiry requests;

receiving an inquiry response from said key device; and obtaining said wireless communication address of said key device by reading its Bluelooth™ address from said inquiry response.

Step b) may further involve determining a current time; and steps c) and d) may further involve comparing said current time with a number of time slots associated with a particular one of the stored wireless communication addresses that matches the determined key device address, a requisite for a positive evaluation result being that the current time falls within any of said time slots.

The wireless communication addresses stored in the data storage may be associated with respective authority levels, wherein steps c) and d) may involve:

for a particular one of the stored wireless communication addresses that matches the determined key device address, generating a first evaluation result if an authority level associated with said particular address meets or exceeds a predetermined authority level, and otherwise generating a second evaluation result, wherein said first evaluation result corresponds to said positive evaluation result and causes performance of step e), and wherein said second evaluation result causes, instead of step e), performance of the following steps:

f) establishing a two-way communication link between said lock device and said key device pursuant to said communication standard;

g) receiving verification data from said key device over said communication link;

h) authenticating said key device by matching the received verification data with authentication data stored in said data storage and associated with said particular address; and i) upon successful authentication of said key device in step h), unlocking said lock.

This allows handling of certain prioritized and/or trusted users according to the fast unlocking method described earlier, whereas other users may be checked more carefully by retrieving their verification data over the two-way communication link for examination in the lock device.

Time slots are preferably provided in first and second types, said first type of time slot representing a first authority level which meets or exceeds said predetermined authority level, and said second type of time slot representing a second authority level which is below said predetermined authority level, the method involving the step of deciding that said authority level associated with said particular address is said first authority level if said current time falls within at least one time slot which is of said first type and is associated with said particular address.

The verification data may include a PIN (Personal Identification Number) code, or biometric data in the form of e.g. a digital fingerprint sample.

The method may further involve the introductory steps of detecting the presence of a user in a vicinity of said lock device and in response triggering performance of step a). This allows the lock device to rest in a sleep mode with negligible power consumption during periods of inactivity. Only elements that handle the detection of the user's presence will need to be active during such a sleep mode. In turn, such optimum power preservation allows implementing the lock device as a stand-alone device that may operate autonomously for long periods of time, powered by its own power source such as batteries.

The presence of the user may be detected by receiving a detection signal from a proximity sensor positioned and adapted to monitor the vicinity of said lock device. The proximity sensor may be selected from the group consisting of: an IR (Infra-Red) sensor, an ultra-sound sensor, an optical sensor, an RF (Radio Frequency) sensor or a pressure sensor. Alternatively, for embodiments where the lock device is mounted to a door having a door handle, the proximity sensor may be positioned on or at said door handle and be adapted to generate said detection signal by electrically detecting interaction from said user on said door handle.

A step of storing said wireless communication address, as determined in step b), in said data storage allows generation of a log file and/or statistics by collecting wireless communication addresses for different key devices as stored in the data storage; and transmission of said log file and/or statistics to said key device over said communication link.

The method may involve the steps of receiving authentication data updating information from said key device over the communication link established in step f);

determining a first time stamp in the authentication data updating information received, said first time stamp reflecting a time of origin for the authentication data updating information;

determining a second time stamp for the authentication data currently stored in the data storage in the lock device; and updating the authentication data currently stored in the data storage in the lock device with authentication data included in the authentication data updating information received, if said first time stamp is newer than said second time stamp.

Further steps may involve determining a third time stamp in the authentication data updating information received, wherein said third time stamp reflects a time of receipt of said authentication data updating information at said key device from a remote server, and wherein said first time stamp reflects a creation time of said authentication data updating information at said server; and performing said updating step only if said first time stamp is older than said third time stamp, and both of said first and third time stamps are newer than said second time stamp.

In general terms the inventive device is a lock device for unlocking a lock, having means for short-range wireless data communication device in compliance with a communication standard;

means for detecting a key device within operative range of the lock device;

means for determining a wireless communication address of the key device;

a data storage with a number of wireless communication addresses stored therein;

means for evaluating the determined key device address by referring to the number of wireless communication addresses stored in the data storage and generating an evaluation result, wherein a match between the determined key device address and any of the wireless communication addresses stored in the data storage is a requisite for a positive evaluation result; and means for unlocking said lock if a positive evaluation result is generated.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

Figure 5:
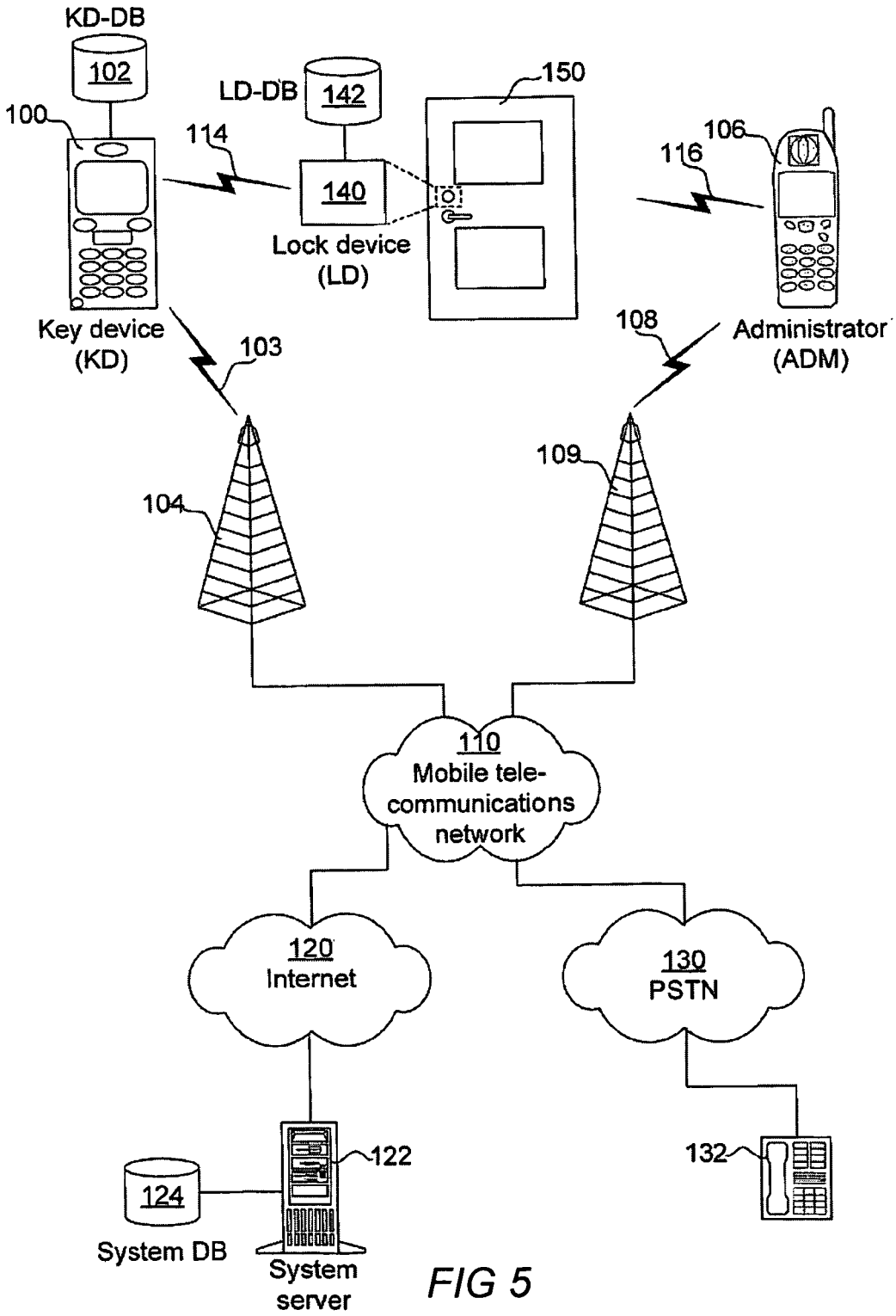
FIG. 5 is a schematic illustration of a telecommunication system, including a wireless key device implemented by a mobile terminal, a wireless lock device for a door, a wireless administrator device implemented by a mobile terminal, an administrator server, a mobile telecommunications network and a couple of other elements, as an example of an environment in which the present invention may be applied.

The present invention is advantageously implemented in a mobile telecommunications system, one example of which is illustrated in FIG. 5. Central elements in FIG. 5 are a wireless key device (KD) 100 and a wireless lock device (LD) 140. The purpose of the lock device 140 is to control some sort of lock mechanism in a lock, which in the illustrated example is a door lock on a door 150. In turn, the lock device 140 is operated by the key device when brought in the vicinity of the lock device. In more particular, both the key device 100 and the lock device 140 are enabled for short-range wireless data communication in compliance with a communication standard. In the preferred embodiment, this communication standard is Bluetooth™. Having been the de facto standard for short-range wireless data communication for mobile devices during several years already, Bluetooth™ is believed to be very well known to the skilled person, and no particulars about Bluetooth™ as such are consequently given herein.

As with most other contemporary mobile telecommunications systems, the system of FIG. 5 provides various telecommunications services such as voice calls, data calls, facsimile transmissions, music transmissions, still image transmissions, video transmissions, electronic message transmissions and electronic commerce for mobile terminals in the system, such as aforementioned mobile terminal 100, another mobile terminal 106, personal digital assistants (PDA) or portable computers. It is to be noticed that these various telecommunications services are not imperative to the invention, and for different embodiments, different ones of the telecommunications services may or may not be available.

In FIG. 5, the key device 100 is implemented by any commercially available, Bluetooth™-enabled mobile terminal 100, one embodiment 200 of which is shown in FIG. 2. As seen in FIG. 2, and as is well known in the art, the mobile terminal 200 comprises an apparatus housing 201, a loudspeaker 202, a display 203, an input device 204*a-c*, and a microphone 205. In the disclosed embodiment, the input device 204*a-c* includes a set of keys 204*a* arranged in a keypad of common ITU-T type (alpha-numerical keypad), a pair of soft keys or function keys 204*b*, and a biometrical data reader 204*c* in the form of a fingerprint sensor. Hence, a graphical user interface 206 is provided, which may be used by a user of the mobile terminal 200 to control the terminal's functionality and get access to any of the telecommunications services referred to above, or to any other software application executing in the mobile terminal. With particular reference to one embodiment of the present invention, the keypad 204*a* may be used for entering a PIN code to be used for authenticating the key device 100 in the lock device 140 in order to decide whether or not to unlock the lock controlled by the lock device. In another embodiment, the biometrical data reader 204*c* is used correspondingly to produce a digital fingerprint sample from the user, said fingerprint sample being used for authenticating the key device 100 in the lock device 140 by matching with prestored fingerprint templates.

Figure 6:
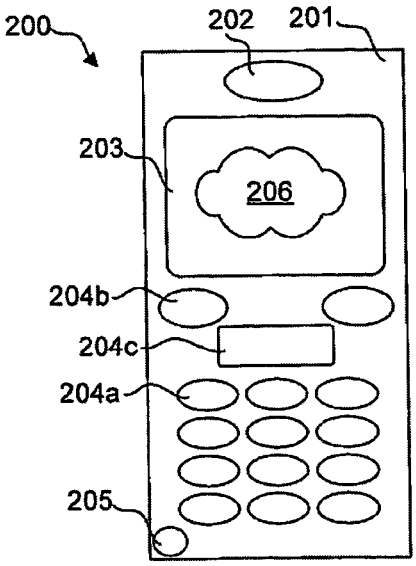
FIG. 6 is a schematic front view illustrating the wireless key device of FIG. 5, and in particular some external components that are part of a user interface towards a user of the wireless key device.

In addition, but not shown in FIG. 6, the mobile terminal 200 of course comprises various internal hardware and software components, such as a main controller (implemented e.g. by any commercially available Central Processing Unit (CPU), Digital Signal Processor (DSP) or any other electronic programmable logic device); associated memory, such as RAM memory, ROM memory, EEPROM memory, flash memory, hard disk, or any combination thereof; various software stored in the memory, such as a real-time operating system, a man-machine or user interface, device drivers, and one or more various software applications, such as a telephone call application, a contacts application, a messaging application, a calendar application, a control panel application, a camera application, a mediaplayer, a video game, a notepad application, etc; various I/O devices other than the ones shown in FIG. 6, such as a vibrator, a ringtone generator, an LED indicator, volume controls, etc; an RF interface including an internal or external antenna as well as appropriate radio circuitry for establishing and maintaining an RF link to a base station; aforementioned Bluetooth™ interface including a Bluetooth™ transceiver; other wireless interfaces such as WLAN, HomeRF or IrDA; and a SIM card with an associated reader.

The mobile terminals 100, 106 are connected to a mobile telecommunications network 110 through RF links 103, 108 via base stations 104, 109. The mobile telecommunications network 110 may be in compliance with any commercially available mobile telecommunications standard, such as GSM, UMTS, D-AMPS or CDMA2000.

The mobile telecommunications network 110 is operatively connected to a wide area network 120, which may be Internet or a part thereof. Various client computers and server computers, including a system server 122, may be connected to the wide area network 120.

A public switched telephone network (PSTN) 130 is connected to the mobile telecommunications network 110 in a familiar manner. Various telephone terminals, including a stationary telephone 132, may be connected to the PSTN 130.

Figure 8:
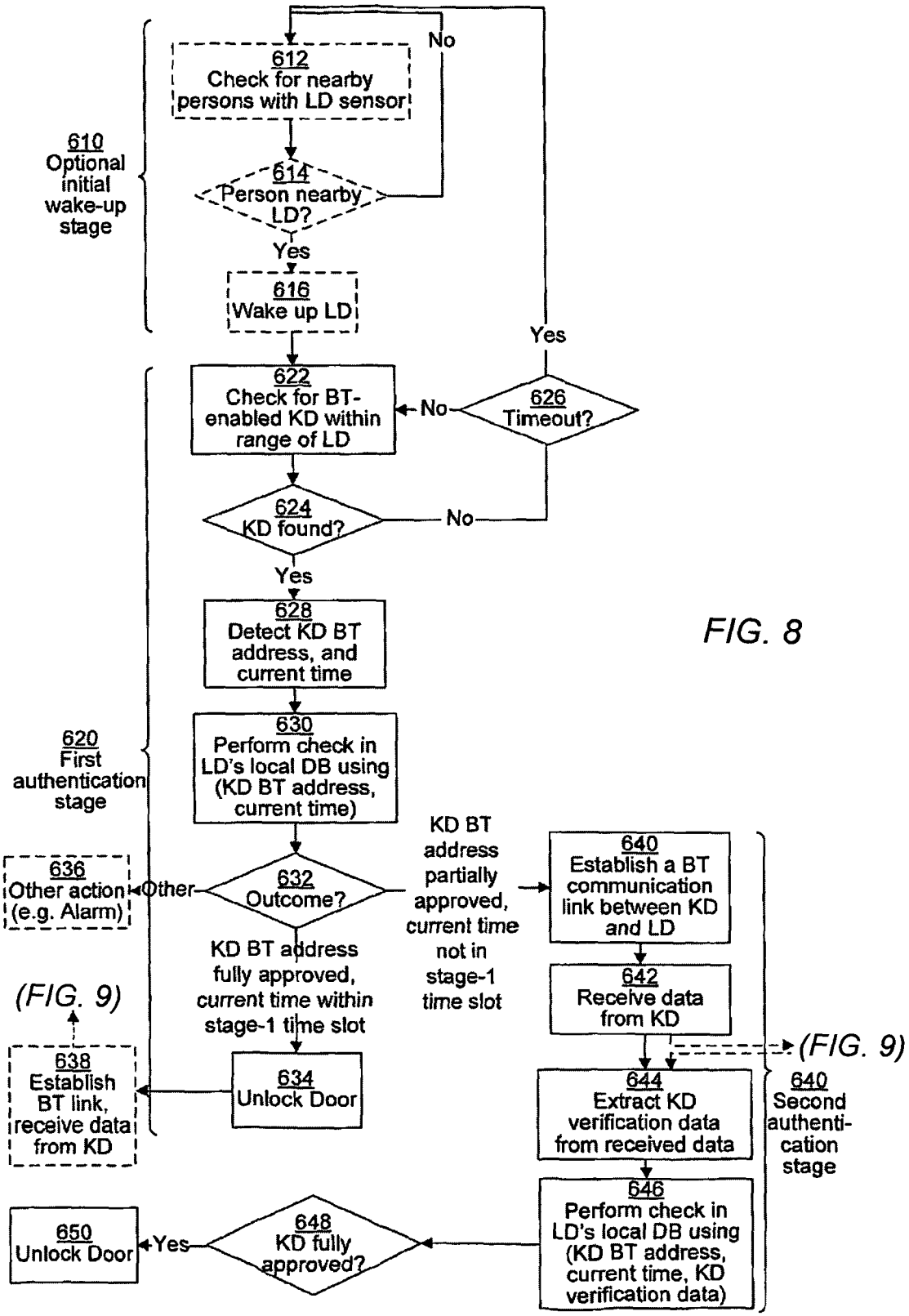
FIGS. 8 and 9 are flowchart diagrams of a method of unlocking the lock device by the key device of the previous drawings.
Figure 9:
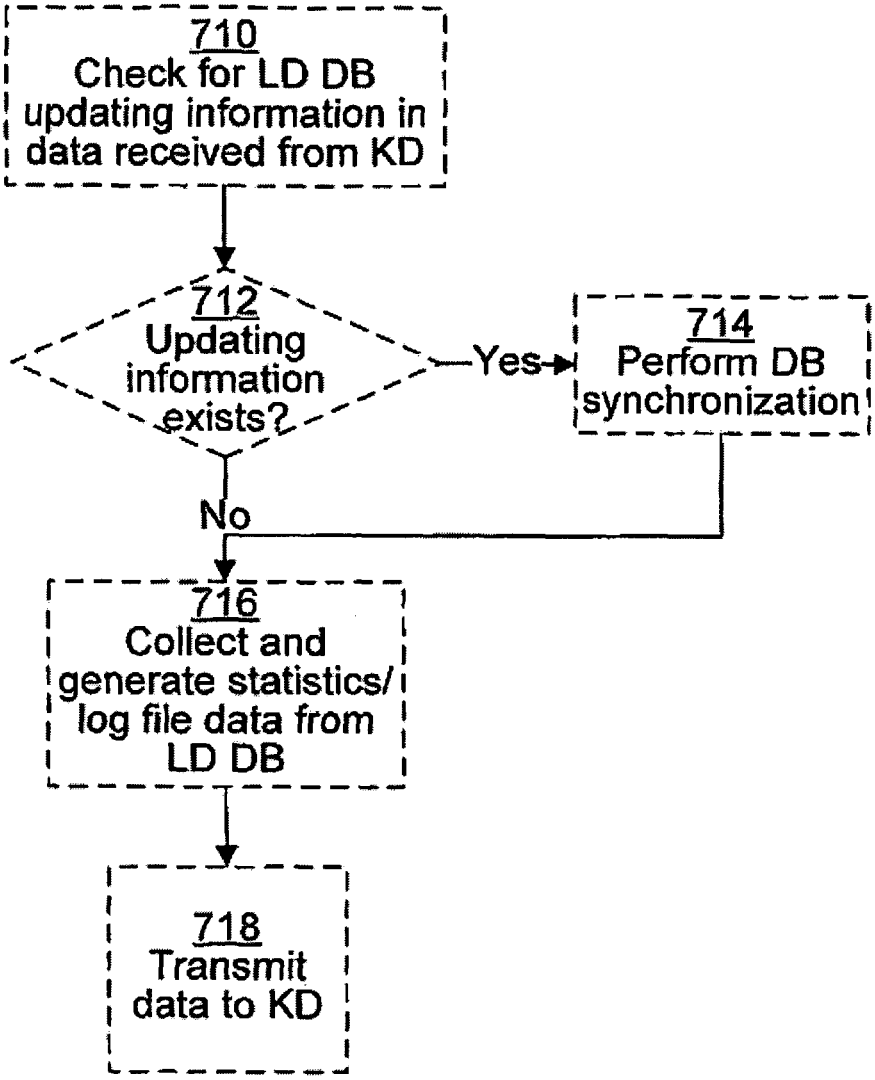

The CPU 313 is programmed to read and execute program instructions stored in a memory 311 so as to perform a method for wireless automatic unlocking of the lock 160 in response to the appearance and proper authentication of the key device 100. An embodiment of this method is illustrated in FIGS. 8 and 9 and will be described in more detail later.

The lock device 140 is a stand-alone, autonomously operating device which requires no wire-based installations, neither for communication nor for power supply. Instead, the lock device 140 is powered solely by a local battery power unit 303 and interacts with the key device, as already mentioned, by Bluetooth™-based activities. To this end, the lock device 140 has a Bluetooth™ radio module 309 with an antenna 310.

The lock device 140 of the present embodiment further includes a real-time clock 304 capable of providing the CPU 313 which an accurate value of the current time. A detector 312*b* is positioned to detect that the door 150 is in a properly closed position, so that the CPU 313 may command locking of the lock 160 a certain time after a user has opened the door through the key device 100 and passed therethrough. The detector 312*b* may be a conventional magnetic switch having a small magnet mounted to the door frame and a magnetic sensor mounted at a corresponding position on the door leaf 152.

The lock device 140 may have a simple user interface involving button(s) 305, a buzzer 312*a* and LED indicator(s) 312*c*. In some embodiments, an authorized administrator (ADM) may configure the lock device 140 through this user interface. In other embodiments, though, configuration of the lock device 140—including updating the contents of a local database (LD-DB) 142 stored in memory 311 and containing i.a. key device authentication data—occurs wirelessly either directly from a proximate mobile terminal 106 over a Bluetooth™ link 116, or by supplying a key device, for instance key device 100, with authentication data updating information from a system database 124 at the system server 122 over the mobile telecommunications network 110.

Since the lock device 140 is a stand-alone, battery-powered installation which is intended to be operative for long time periods without maintenance, it is important to keep power consumption at a minimum. Therefore, the present embodiment is designed to put itself in a sleep mode after a certain period of inactivity. In the sleep mode, the elements of the lock device 140 are inactive and consume negligible power. The way to exit the sleep mode and enter operational mode is by applying a wake-up control signal 326 on a particular control input on the CPU 313. To this end, the lock device 140 is provided with a wake-up arrangement 320 having a proximity sensor 324 and associated circuitry 322.

The proximity sensor 324 is positioned to detect the presence of a user in a vicinity of the lock device 140, and in response the circuitry 322 is adapted to generate the wake-up control signal 326. The proximity sensor 324 may for instance be an IR (Infra-Red) sensor, an ultra-sound sensor, an optical sensor, an RF (Radio Frequency) sensor or a pressure sensor. Such types of sensors are all well known to the skilled person and are commercially available. For instance, when the proximity sensor 324 is an RF sensor, it may advantageously be adapted to detect mobile telecommunications traffic, such as GSM traffic, to or from the mobile terminal which implements the key device 100. Thus, in this case the proximity sensor 324 does not detect the user himself but the key device 100 he carries. When the proximity sensor 324 is a pressure sensor, it may advantageously be located at floor level somewhere near the door 150, so as to detect pressure variations caused be the user when stepping on the floor.

Alternatively, the proximity sensor 324 may be positioned on or at the door handle 161 and be adapted to generate a detection signal by electrically detecting interaction from the user on the door handle, for instance by capacitive means or by detecting the closure of an electric circuit.

Additionally, means such as a depressible button may be provided on or at the door 150 on the inside of the premises in question. The user may avail himself of such means to cause forced unlocking of the door lock 160 when he desires to leave the premises. To this end, such means will be coupled to the CPU 313, and the latter will be adapted to perform the forced unlocking of the door lock 160 by generating the control signal 307*b* to the motor controller 307 so as to control the motor 308 in the manner previously described.

Referring now to FIGS. 8 and 9, an operational method performed by the lock device 140 for wireless automatic unlocking of the lock 160 will now be described in detail.

On a general level, the method consists of two main authentication stages 620 and 640, and, in the present embodiment but optionally, an initial wake-up stage 610. The first authentication stage 620 is designed to be fast and therefore does not involve any establishment of a two-way Bluetooth™ communication link between lock device and key device. Experiments have indicated that the first authentication stage, resulting in the opening of a door, may be completed in as little time as 2-4 seconds, which is considerably faster than in the prior art.

In the first authentication stage, authorization is based solely on the key device's Bluetooth™ address and the current time, both of which are detected automatically by the lock device 140 and require no interaction from the user (other than bringing the key device 100 near the door 150). Certain prioritized users are entrusted to unlock the door 150 simply through this first authentication stage 620, whereas other users must be authorized during the following, second and more extensive authentication stage 640 which requires establishment of a two-way Bluetooth™ communication link and involves additional verification data from the key device 100—in the form of a PIN code in the present embodiment.

The lock device 140 bases its operation upon the authentication data stored in LD-DB 142. In the present embodiment, the record structure of the LD-DB 142 includes the following data fields for authentication data:

| Field | Contents example #1 | Contents example #2 |
|---|---|---|
| LD ID | 121 | 121 |
| User name | Olle | Johan |
| Bluetooth ™ ID | 0x00223af3 | 0x002e5af4 |
| Stage-1 time slot (1) | 2005-03-24: 19-22 | |
| Stage-1 time slot (2) | Mon-Fri: 07-15 | |
| . . . | | |
| Stage-1 time slot (n) | | |
| Stage-2 time slot - single | | |
| Stage-2 time slot - scheduled | 00-24 | Sat-Sun: 10-18 |
| PIN code | **** | **** |
| Administrator | No | No |

In the example given above, it is thus configured that user Olle is authorized to open the door 150, through the lock device 140 having ID 121, by using his key device 100 having Bluetooth™ ID 0x00223af3 by fast stage-1 authentication during working days between 07:00 and 15:00. He is also granted a temporary stage-1 authority on 24 Mar. 2005 between 19:00 and 22:00. If he arrives at the door outside of these stage-1 time slots, he may still access the door 150 at any time (00-24), but in such a case he must go through a more complex stage-2 authentication which involves additional authorization, namely by providing a PIN code from the key device 100 and having it communicated to the lock device 140 over a two-way Bluetooth™ communication link. Stage-2 authentication requires a special software in the key device 100, since data exchange is involved. Therefore, if mobile terminals are used as key devices, they are preferably of an advanced model provided with a suitable operating system, such as Symbian, at least for users that require stage-2 authentication. As regards the PIN code, it may either be prestored in memory in the key device 100 and fetched by the software therein upon communication to the lock device, or the software may invite the user to enter his PIN code manually on e.g. the keypad 204*a* upon establishment of the two-way Bluetooth™ communication link. In other embodiments, if biometric data instead of PIN code is used as verification data, they are treated in the corresponding way, i.e. either prestored in memory or read by e.g. the fingerprint sensor 204*c*. It is to be observed that all communication between key device and lock device is encrypted in accordance with an encryption algorithm, such as Blowfish. Therefore, data integrity is ascertained.

As for user Johan, only stage 2-authentication is available to him, and only on weekends between 10:00 and 18:00.

With reference to FIG. 8, assuming that the lock device 140 is in sleep mode, the initial wake-up stage 610 is performed in steps 612, 614 and 616 by using the proximity sensor 324 to detect the presence of the user of key device 100 near the lock device 140 and in response generate the wake-up control signal 326 to the CPU 313.

This causes the CPU 313 to enter the first authentication stage 620. A step 622 searches for Bluetooth™-enabled devices by paging, i.e. sending inquiry requests at regular intervals. Each Bluetooth™-enabled device within operating range (i.e. within a radius of some meters from the lock device 140, depending on e.g. the output power of the Bluetooth™ radio module 309 and the performance of the Bluetooth™ transceivers in the devices paged for) will transmit an inquiry response to the lock device. It is checked in step 624 whether at least one inquiry response is received within a time limit; if not a time out 626 occurs and the lock device 140 returns to sleep mode.

If an inquiry response was received, step 628 proceeds to determine the Bluetooth™ address from the inquiry response. Moreover, a current time is determined by reading a value from the real-time clock 304.

Then, the CPU 313 proceeds in step 630 to check whether the determined Bluetooth™ address of the responding device matches one of aforedescribed authentication data records in the LD-DB 142. In case of a match, it is also checked whether the current time falls within any stage-1 time slot defined for that Bluetooth™ address. If the outcome of these checks is fully positive, as checked in step 632, the CPU 313 proceeds to step 634 and generates the control signal 307*a* to the motor controller 307. As described above, this will cause unlocking of the door lock 160 and allow the door 150 to be opened.

If the check in step 632 reveals that the determined Bluetooth™ address is not present in the LD-DB 142, or that the Bluetooth™ address is present but the current time matches neither a stage-1 time slot nor a stage-2 time slot for that address, then the door lock 160 will not be unlocked, and the execution will return to step 622. In some embodiments it is possible to list certain undesired Bluetooth™ addresses as explicitly forbidden in LD-DB 142. If the determined Bluetooth™ address matches such a forbidden Bluetooth™ address, appropriate action may be taken in a step 636, such as generating an alarm signal or registering the access attempt in memory 311 for later reporting.

If the check in step 632 reveals that the determined Bluetooth™ address is present in the LD-DB 142, but that the current time does not fall within any stage-1 time slot defined for that Bluetooth™ address but only within a stage-2 time slot, the execution proceeds to step 640.

In step 640, the CPU controls the Bluetooth™ radio module 309 to establish a two-way Bluetooth™ communication link with the key device 100 detected in step 628. In step 642, data transmitted by the software in the key device 100 is received in the lock device 140. Step 644 extracts verification data, such as a PIN code for key device 100, which as previously explained is included in the received data. Then, in step 646 it is checked whether the extracted verification data matches the corresponding authentication data stored for the key device's Bluetooth™ address in LD-DB 142. In case of a match, step 648, the CPU 313 proceeds to step 650 and generates the control signal 307*a* to the motor controller 307. Again, this will cause unlocking of the door lock 160 and allow the door 150 to be opened.

Figure 7:
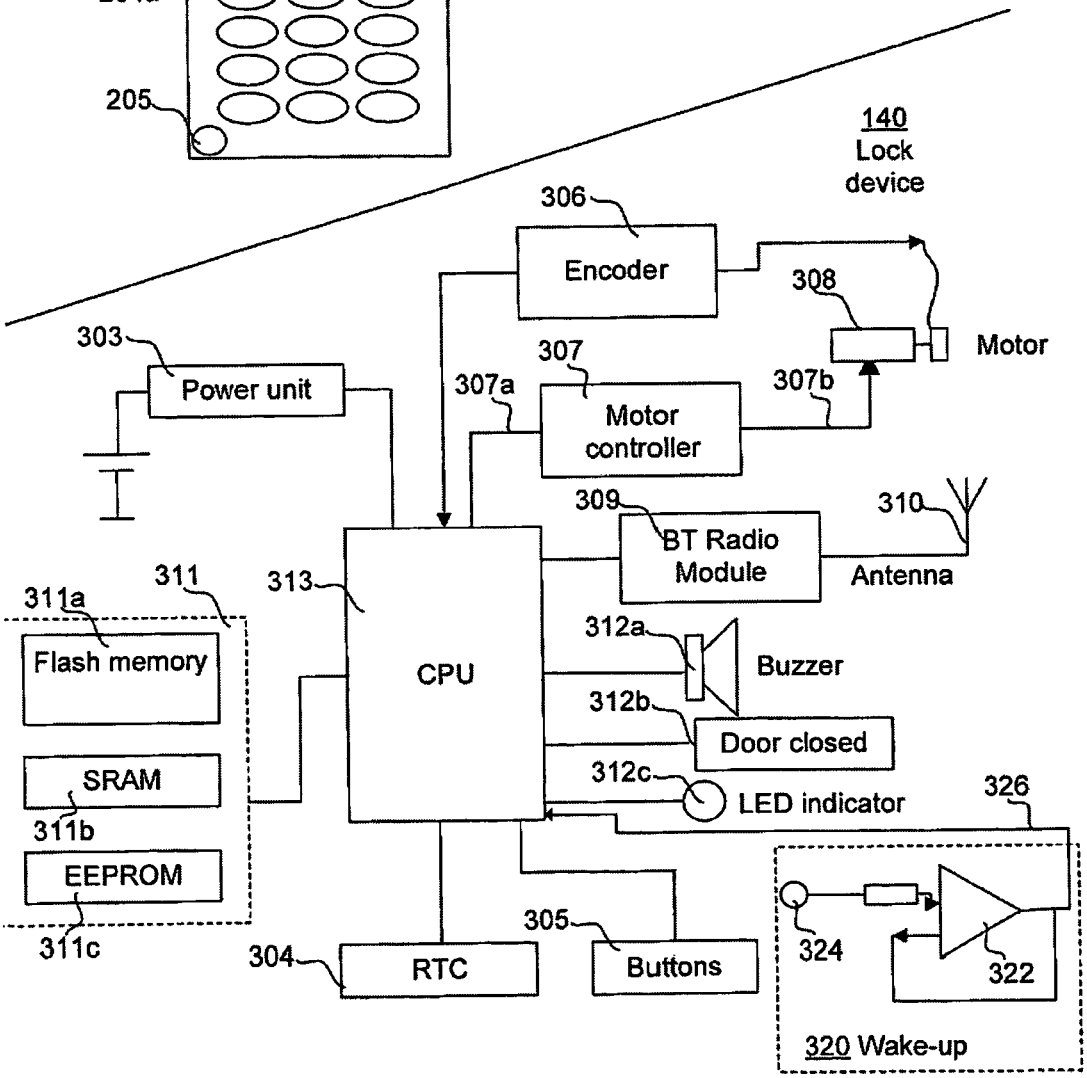
FIG. 7 is a schematic block diagram illustrating internal components and modules of the wireless lock device of FIG. 1.

Once there is an established two-way Bluetooth™ communication link between key device 100 and lock device 140, i.e. upon completion of step 640, it is possible to use this link for exchanging also other kind of data than aforesaid verification data. As seen in FIG. 7, it may be checked in a step 710 whether the data received from the key device 100 contains authentication data updating information for the intention of updating the authentication data records stored in LD-DB 142, for instance in order to reflect the addition of a new user/key device at the system server 122, or a change in authority for an existing user—e.g. a change in its stage-1 or stage-2 time slot.

Such updating information may have been distributed to the key device 100, as well as to other key devices in the system, from the system server 122 over the mobile telecommunications network 110, for instance as an attachment in an MMS or email message. Updating information originating from the system server 122 (system DB 124) is encrypted before transmission to the key device 100 (if not already when stored in system DB 124), and upon reception the key device 100 stores the updating information as an encrypted dataset in local memory (KD-DB 102). Thus, the updating information is not decrypted by the key device 100, which prevents unauthorized manipulation of the information. For further data security, a system time stamp is preferably included in the updating information distributed from the system server 122, and the key device may store the updating information with a key device time stamp in its KD-DB 102, said key device time stamp representing the time of receipt of the updating information from the system server in the key device.

If in step 712 updating information is found to exist in the received data, the CPU 313 proceeds to step 714 so as to update the contents of the LD-DB with the updating information received from the key device 100. Before this is done, however, the CPU 313 preferably determines a time stamp of the received updating information, such as the aforementioned system time stamp and/or key device time stamp, and compares it or them to a cur-rent time stamp for the present authentication data in the LD-DB 142. Only if according to this comparison the updating information from the key device 100 is newer will the actual update in LD-DB 142 take place. For improved security, the CPU 313 may choose to allow updating of the LD-DB 142 only if the current time stamp of the LD-DB 142 is older than both the key device time stamp and the system time stamp, and if the key device time stamp is newer than the system time stamp.

Performing such updating of the LD-DB 142 prior to performing the authentication check of the key device 100 in step 646 allows the key device to bring about updating information that may actually change the outcome of its own authentication. For instance, if the key device 100 belongs to a new user which has not previously been represented in the LD-DB, it may nevertheless bring about updating information that will give itself stage-1 or stage-2 authority after the update of the LD-DB. A condition is, of course, that authentication data for that key device has been duly created by the administrator at the server 122 and has reached the key device 100 prior to the arrival thereof at the lock device 140. To this end, in some embodiments, step 632 will be followed by an attempt for stage-2 authentication in step 640, even if no matching Bluetooth™ address is found during stage-1 authentication. Another optional step 716 involves compiling historic data about previous accesses to the door 150 through the lock device 140. Such historic data may have been created by the CPU 313 each time a key device has been subjected to authentication by the lock device 140 and may comprise the detected Bluetooth™ address of each such key device, and a time stamp representing the time it happened. Such historic data may be stored in an event register in the LD-DB 142. In step 716, a log file and/or statistics may be generated by reading the historic data from the event register. The log file and/or statistics is/are transmitted as a dataset to the key device 100 in step 718. Upon receipt thereof, the software in the key device 100 may store the dataset in its KD-DB 102 for immediate or later forwarding to the system server 122 over the mobile telecommunications network 110, essentially like the distribution of aforesaid updating information but in the reverse order and direction. In this way, at the system server the administrator may analyze such log file and/or statistics not only for the lock device 140 but also for other lock devices in the system, thereby being given an overview of the operational situation in the entire system.

In some embodiments, after a successful stage-1 unlocking in step 634, the execution may proceed to step 638, in which a two-way Bluetooth™ communication link is established, and then with the above-described steps of FIG. 7 so as to exchange authentication data updating information and/or statistics/log file data with the key device 100.

In an alternative embodiment, the lock device 140 is physically divided into two units. A first unit, capable of wireless communication such as Bluetooth™, is mounted at a nearby mains power socket to receive electric power therefrom. Thus, the first unit need not be optimized in terms of power consumption. The first unit is capable of performing the afore-described first and, if applicable, second authentication stages for an available key device and generate a control signal to a second unit, which will be mounted at the lock in question and cause unlocking of its lock mechanism upon receipt of a successful control signal from the first unit. Thus, the second unit will contain the electromechanical elements necessary to perform this task. The second unit is advantageously battery-powered and adapted to receive the control signal from the first unit over a wireless interface, such as Bluetooth™. Since power consumption is not an issue for the first unit, this may advantageously be adapted to scan continuously for key devices in the neighborhood, i.e. the wake-up arrangement described above may be dispensed with. This allows further miniaturization and simplification of the second unit. One first unit may be configured to handle and control several second units, each mounted at a respective door, window, etc—the first unit thereby functioning like a central locking device.

The invention has mainly been described above with reference to a few embodiments. However, as is readily appreciated by a person skilled in the art, other embodiments than the ones disclosed above are equally possible within the scope of the invention, as defined by the appended patent claims. For instance, even if the disclosed embodiments relate to opening of doors, the invention may just as well be used for controlling other kind of objects, including but not limited to garage ports and various other equipment at homes, offices or public buildings. For instance, the invention may be used for wireless actuation of a safety lock of the well known "safety chain" type, i.e. a lock which has three primary positions: a locked position, an open or unlocked position, and a safety position in which the protected door, window, etc, can be opened only a short distance. One example of such a safety lock is found in WO 04/083576.

Further, even if the disclosed embodiments use Bluetooth™ for the short-range wireless data communication, another communication standard is also feasible, including but not limited to WLAN or HomeRF. Further, in the illustrated embodiments the lock device has been exemplified by an external device, mounted to a door blade. It should be understood, however, that the inventive concept is applicable for incorporation in lock cases, such that a lock case having features according to the inventive concept may be accomplished.

The invention claimed is:

1. A lock device adapted to place a lock in an unlocked state by transferring a lock catch from a locking position to a releasing position, said lock device comprising:

an electric motor of the lock device mechanically connected to an axle via a transmission device of the lock device, rotation of the axle actuating the lock catch, said transmission device including a gear, said gear including a weakening structure adapted to break and disrupt the mechanical connection between the electric motor and the axle upon a threshold force being exceeded such that the lock is placeable in the unlocked state by manual turning of a lock knob connected with said axle.

2. The lock device of claim 1, wherein the transmission device further includes a gear wheel comprising a central region, a peripheral region, and an intermediate weakening region including the weakening structure.

3. The lock device of claim 1, wherein the weakening structure comprises a structural weakening.

4. The lock device of claim 2, wherein the weakening structure comprise an adhesive bond, releaseably bonding the central region to the peripheral region.

5. The lock device of claim 2, wherein the weakening structure comprises at least one structure extending radially between the central region and the peripheral region.

6. The lock device of claim 1, further comprising means for monitoring the current consumed by the electric motor.

7. The lock device of claim 6, further comprising means for evaluation of the monitored current and storage means for storing a preset value regarding the current.

8. The lock device of claim 7, wherein the lock device is capable of determining whether the lock device is in a locked state or not based on a comparison between the monitored current and the preset value.

9. A method for mounting a lock device to a door leaf comprising:

mounting a fastening plate having an annular projection that projects toward and is configured to receive the lock device at a plurality of positions, to the door leaf, selecting a mounting position from among the plurality of positions, and mounting the lock device to the fastening plate, wherein connection between the fastening plate and the lock device allows for positioning of the lock device at different angles relative to the fastening plate.

10. A method for mounting an electrically driven lock actuating device to a door leaf of a door, the door having a lock with an internal lock mechanism inside the door leaf, and a lock catch which is actuatable by rotation of an axle of said internal lock mechanism, the lock actuating device having an electric motor and a transmission for connection to said internal lock mechanism, the method comprising:

providing a circular fastening plate;

attaching a base plate of the lock actuating device to the door leaf next to the lock catch by fastening the base plate directly to the circular fastening plate, thereby allowing the base plate to be mounted in a plurality of angles around the periphery of the fastening plate; and connecting the transmission of the lock actuating device to said internal lock mechanism, wherein actuation of said electric motor will cause actuation of said lock catch.

11. The method of claim 10, the door having a protective plate situated between the door leaf and a lock knob of the lock, wherein the method comprises replacing the protective plate with said circular fastening plate.

12. The method of claim 11, wherein the base plate is fastened to the circular fastening plate using pre-existing fastening screw openings used to fasten the protective plate to the door leaf.

13. The method of claim 11, comprising initially temporarily removing the lock knob from the lock.

14. The lock device of claim 1, wherein the electric motor includes a transmission axle and the transmission device is mounted on an end of the transmission axle.

15. The lock device of claim 1, wherein the weakening structure includes a frangible portion.

16. The lock device of claim 2, wherein the weakening structure comprises a structural weakening.

17. The lock device of claim 3, wherein the structural weakening includes apertures, recesses or cavities in the weakening region.

18. The lock device of claim 7, wherein the preset value is a threshold value or a reference curve.

19. The lock device of claim 16, wherein the structural weakening includes apertures, recesses or cavities in the intermediate weakening region.

20. The lock device of claim 16, wherein the weakening structure comprises at least one structure extending radially between the central region and the peripheral region.

21. The lock device of claim 19, wherein the weakening structure comprises at least one structure extending radially between the central region and the peripheral region.

22. An arrangement for mounting a lock device to a door leaf, comprising:

a fastening plate adapted for fastening to the door leaf, wherein the fastening plate further comprises means for fastening the lock device to the fastening plate, and wherein said means for fastening the lock device to the fastening plate comprises an annular projection having a circumferential groove for mating cooperation with at least one fastening device of the lock device, wherein the lock device may be arranged at defined or optional angles relative to the fastening plate.

23. The arrangement of claim 22, wherein the fastening plate comprises projections extending on the side facing, in a mounted position, the door leaf for increasing the friction between the fastening plate and the door leaf.

24. An arrangement for allowing mounting of a lock device in different directions to a door leaf having a lock catch, the arrangement comprising:

a circular fastening plate adapted to be fastened directly against a surface of the door leaf, and for attaching a base plate of the lock device to the door leaf next to the lock catch by fastening the base plate directly to the circular fastening plate, thereby allowing the base plate to be mounted in a plurality of angles around the periphery of the fastening plate.

* * * * *